United States Patent [19]

Walker

[11] 4,031,683

[45] June 28, 1977

[54] PANEL INTERLOCK

[76] Inventor: Ray R. Walker, 6209 N. Hill Lane, Fort Worth, Tex. 76135

[22] Filed: June 18, 1975

[21] Appl. No.: 587,997

[52] U.S. Cl. ..... 52/536; 52/588

[51] Int. Cl.[2] ..... E04D 1/08

[58] Field of Search ..... 52/537, 536, 538, 542, 52/588, 539

[56] References Cited

UNITED STATES PATENTS

| | | | |
|---|---|---|---|
| 713,577 | 11/1902 | Wickham | 52/539 |
| 1,561,573 | 11/1925 | Smith | 52/588 |
| 1,676,043 | 7/1928 | Olsson | 52/536 |
| 2,021,929 | 11/1935 | Voigt | 52/537 |
| 2,078,011 | 4/1937 | Neher | 52/588 |
| 2,164,681 | 7/1939 | Fould | 52/588 |
| 2,571,273 | 10/1951 | McCullough | 52/537 |
| 3,029,052 | 4/1962 | Early | 52/588 |
| 3,043,407 | 7/1962 | Marryatt | 52/588 |
| 3,568,388 | 10/1968 | Flachbarth | 52/588 |
| 3,618,281 | 11/1971 | Hill | 52/588 |

FOREIGN PATENTS OR APPLICATIONS

| | | | |
|---|---|---|---|
| 779,230 | 4/1935 | France | 52/588 |
| 608,225 | 9/1960 | Italy | 52/537 |
| 334,532 | 1/1954 | Switzerland | 52/588 |
| 910,096 | 11/1962 | United Kingdom | 52/588 |

*Primary Examiner*—Price C. Faw, Jr.
*Assistant Examiner*—Henry Raduazo
*Attorney, Agent, or Firm*—Arthur F. Zobal

[57] ABSTRACT

A panel for construction purposes and having opposite edges to be interlocked with adjacent panels. The panel has a C-shaped interlocked member at one edge and C-shaped slot at the other edge. In assembly the C-shaped member of one panel is slid into the C-shaped slot of the other panel for interlocked purposes.

5 Claims, 9 Drawing Figures

Fig. 1
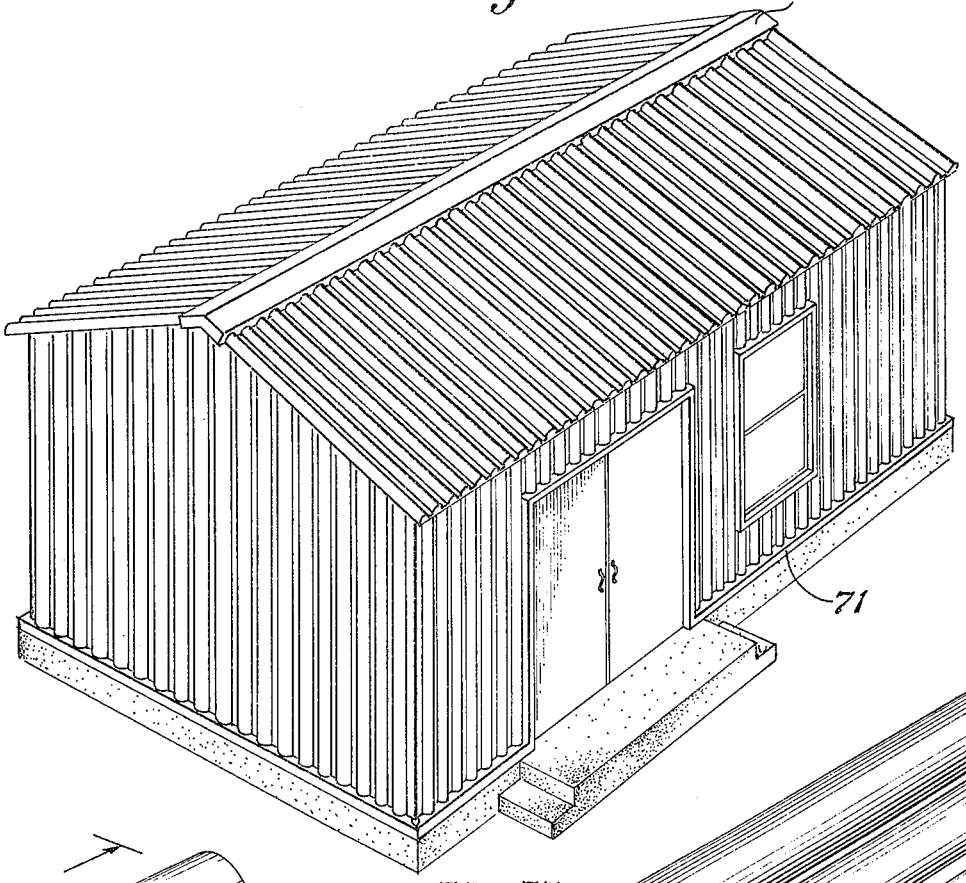
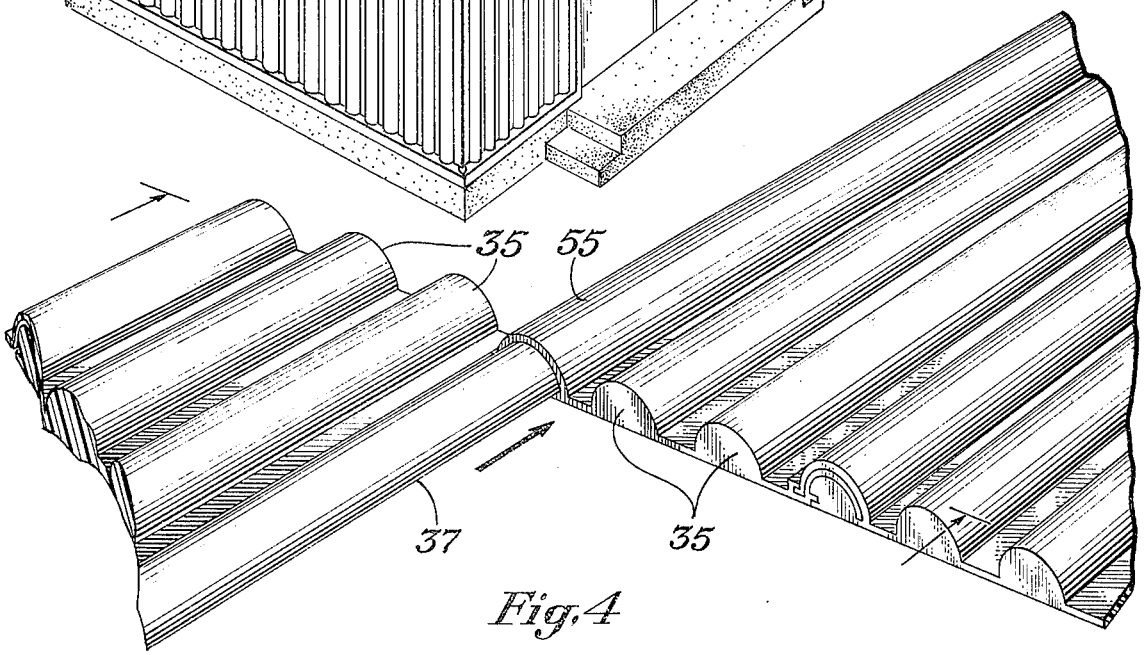
Fig. 4
Fig. 3
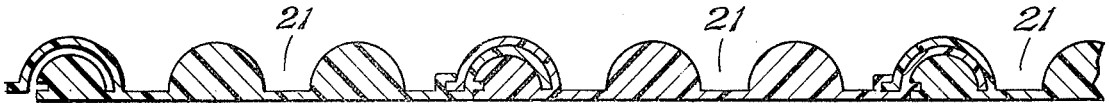
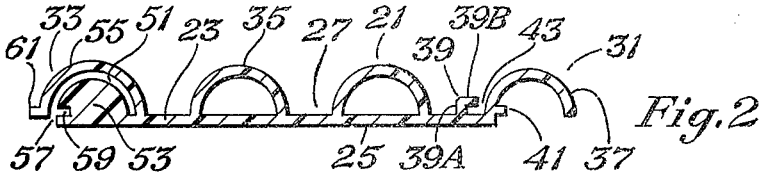
Fig. 2

PANEL INTERLOCK

BACKGROUND OF THE INVENTION

This invention relates to a panel for construction purposes which may be rapidly interlocked with adjacent panels to form an effective and water tight seal.

SUMMARY OF THE INVENTION

In accordance with the present invention there is provided a panel for use for construction purposes in having opposite edges to be interlocked with adjacent panel. The panel comprises a base portion having an inner side and an outer side. One of the edges has an arcuate interlock member extending along the length of said one edge. Said arcuate member as seen in a cross-section through the width of said panel extends outward beyond said base portion and in a direction away from said other edge and has a free edge spaced from said base portion. The other edge of said panel has an arcuate slot extending along the length of said other edge. Said arcuate slot as seen in a cross-section through the width of said panel has an opening along said other edge. Said arcuate slot extends from said opening and outward beyond said base portion and in a direction towards said one edge.

In a further aspect additional male and female interlock members are provided at the opposite edges to facilitate interlocking of adjacent panels. The arcuate member and arcuate slot of said opposite edges are C-shaped and cross-section.

BRIEF DESCRIPTION OF THE DRAWING

FIG. 1 illustrates a building constructed from panels of the present invention;

FIG. 2 is a cross-section of one of the panels of the present invention;

FIG. 3 is a cross-section of three of the panels of the present invention interlocked together;

FIG. 4 illustrates two panels of the present invention being interlocked during assembly;

DETAILED DESCRIPTION OF THE INVENTION

Figure 5:
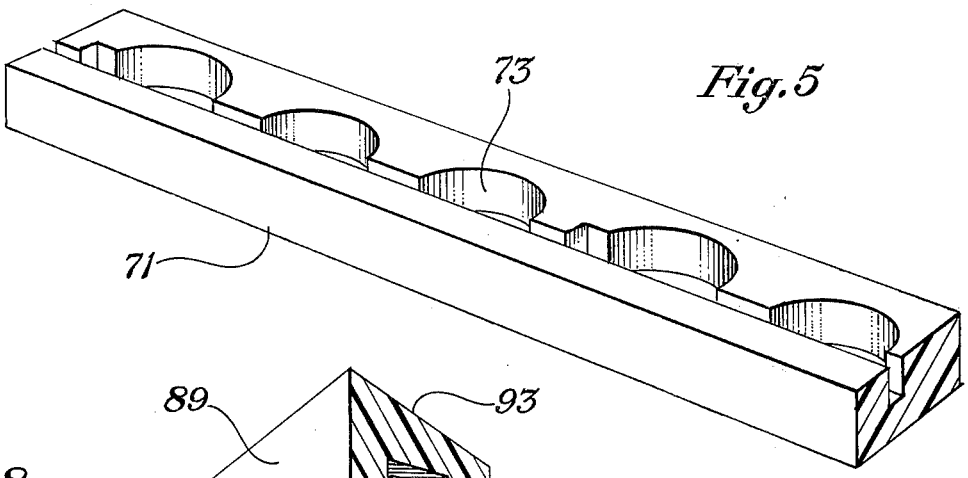
FIG. 5 is a bottom plate having slots or recesses for receiving the lower edge of a panel.

Refer now to FIG. 2, the panel of the present invention is identified at 21 and comprises a base portion 23 having a flat inner side 25 and an outer side 27. Interlocking structure is formed at the opposite edges 31 and 33 of the panel to allow its edges to be interlocked with adjacent panels. Located between the edges 31 and 33 are spaced apart rounded or half-circular ridges 35 which extend along the length of the panel and are employed for support purposes. In FIG. 2, the support ridges 35 are hollow while in FIGS. 3 and 4 the ridges 35 are solid.

At edge 31, the interlocking structure comprises a C-shaped interlocked member 37 extending from the edge of the base portion 23, a L-shaped interlock member 39 and interlock ridge 41. C-shaped member 37 extends along the length of the panel and has an exterior form similar to that of support ridges 35. L-shaped member 39 extends along the length of the panel and is formed on the outer side of the base portion 23 spaced inward from the C-shaped member 37. It comprises a first portion 39A transverse to the plane of the base portion 23 and a second portion 39B which is parallel to the plane of the base portion 23 and extends toward the C-shaped member 37. As illustrated, a L-shaped slot 43 is formed between the L-shaped member 39, the base portion 23, and the C-shaped member 37. The interlocking ridge 41 extends along the length of the panel from the inner sides of the C-shaped member 37 in a direction away from the edge 33.

At edge 33, the interlocking structure comprises a C-shaped slot 51 formed between solid rounded or half-circular structure 53 and a second C-shaped member 55. The rounded structure 53 and the C-shaped member 55 and hence the slot 51 extends along the length of the panel. The slot 51 also has an opening 57 formed along the length of the panel at the edge 33. A slot 59 is formed in the solid structure 53 and an interlocking ridge 61 extends from the free end of the C-shaped member 55. The slot 59 and the interlocking ridge 57 both extend along the length of the panel. The exterior of the C-shaped member 55 has a shape similar to that of the support ridges 35.

Each of the panels are formed exactly alike whereby the edge 31 of one panel may be interlocked with an edge 33 of another panel. Interlocking is carried out by sliding the C-shape member 37 of one panel into the C-shaped slot 51 of another panel as illustrated in FIG. 4. In the interlocking process, ridge 41 of edge 31 will slide into slot 59 of the edge 33 of the other panel while the free end and ridge 61 of C-shaped member 55 of edge 33 will slide into the generally L-shaped slot 43 formed in the edge 31 of the first panel. Three panels interlocked together in this manner are illustrated in FIG. 3. As can be understood, the panels are effectively interlocked to form a water tight joint between the panels. Assembly is simple since all that is required is for the C-shaped member of one edge 31 of one panel to be slid into the C-shaped slot 51 of the edge 33 of an adjacent panel. As shown in FIG. 1, the panels may be employed to construct the sides and roof of a building. At certain intervals, the panels may be nailed to the studs or rafters to securely attach the panels into place. Although not shown, the panels also may be employed for to form fences.

Although the member 37 is shown to be completely C-shaped or generally half-circular in FIGS. 2 and 3, it is to be understood that it may be formed to define an angle of about 90° from the base portion 23 rather than about 180°. Similarly the C-shaped or generally half-circular slot 51 may be formed to define at an angle of about 90° from the opening 57 rather than about 180°.

Figure 8:
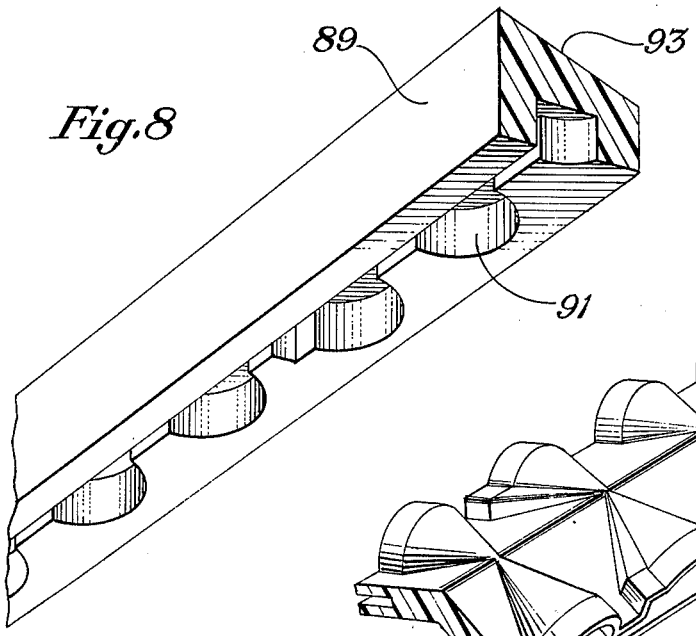
FIG. 8 is a top plate having recesses or slots for receiving the top edge of a panel.
Figure 6:
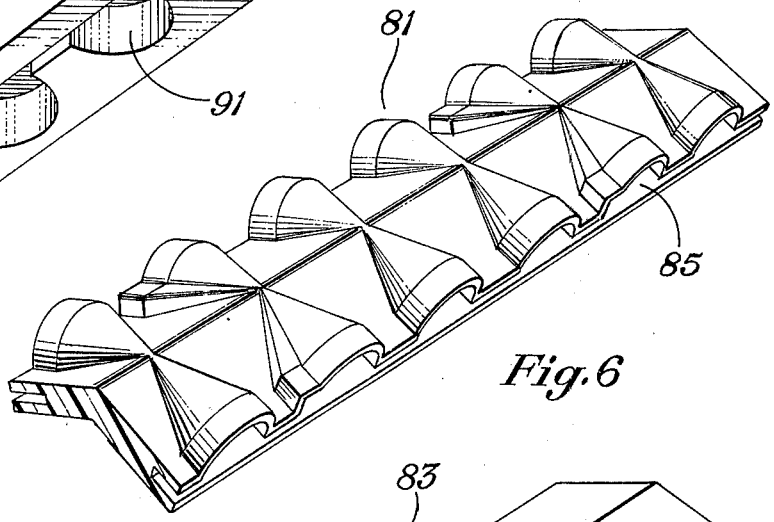
FIG. 6 is a crown mold having slots or recesses for receiving the edges of two panels.
Figure 7:
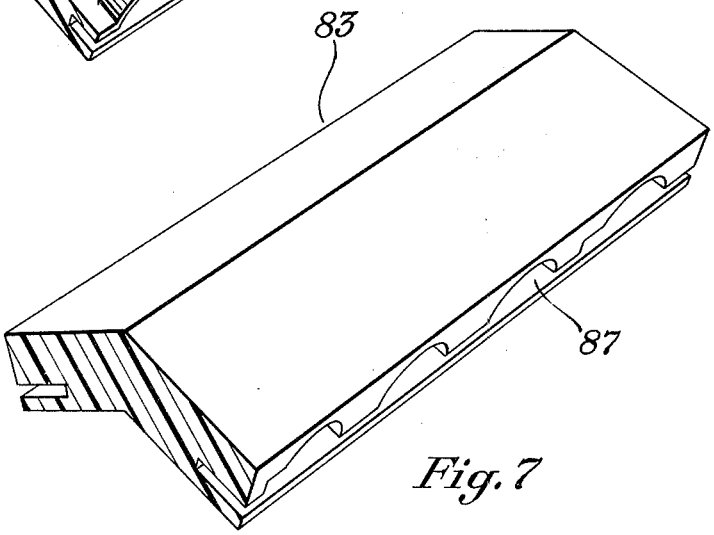
FIG. 7 is a modified crown mold.
Figure 9:
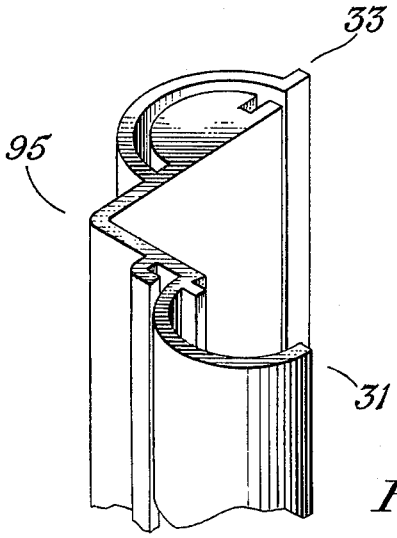
FIG. 9 is a corner panel employing the interlocking edges of the panel of FIG. 2.

Referring now to FIGS. 5–9, there will described accessories for use for facilitating the construction of a building with the panels of the present invention. FIG. 5 illustrates a bottom plate 71 to which may be secured to the foundation and which has slots or recesses 73 for receiving the bottom edges of the side or wall panels as illustrated in FIG. 1. FIGS. 7 and 8 illustrate different types of crown molds 81 and 83 to be secured to the apex of a roof and also having slots or recesses 85 and 87 respectively for receiving the edges of the roof panels. The crown mold 83 of the FIG. 7 is employed in the structure of FIG. 1. FIG. 9 illustrates a top plate 89 having slots or recesses 91 for receiving the top edges of the side or wall panels. In this embodiment, the underside of the roof panels will abut against the top side 93 of the top plate. The top plate may not be necessary to form a joint between the wall panels and a roof panels if the top edges of the wall panels are properly cut. FIG. 9 illustrates a right angled corner panel 93 and 95 which employs the same type of edges 31 and 33 as described with respect to the panel 21 of FIG. 2. The interlocking edges 31 and 33 are employed to receive the edges 33 and 31 respectively of adjacent panels 21 to be interlocked with the corner panel 93.

In one embodiment, the panels of the present invention and the accessories may be formed of aluminum or a suitable plastic such as that formed of polyethylene or of poly vinyl chloride. As now can be understood, the panels of the present invention may be readily assembled together and dissembled when desired. If the panels are formed of plastic, they also may be joined together with a compatible glue for a permanent connection if desired.

I claim:

1. A panel for use for construction purposes and having opposite edges to be interlocked with adjacent panels, comprising:

a base portion having an inner side and an outer side, one of said edges having an arcuate interlock member extending along the length of said one edge, said arcuate member as seen in a cross-section through the width of said panel extends outward beyond said base portion and away from said other edge and has a free edge spaced from said base portion, the other edge of said panel having an arcuate slot extending along the length of said other edge, said arcuate slot as seen in a cross-section through the width of said panel has an opening along said other edge, said arcuate slot extends from said opening outward beyond said base portion and toward said one edge, a L-shaped member extending along the length of said panel from the outer edge of said base portion and located at a position near but spaced inward from said arcuate member, said L-shaped member as seen in a cross-section through the width of said panel comprising a first portion extending outward from said base portion at a position spaced inward from said arcuate member and a second portion extending towards said arcuate member defining an L-shaped slot between said L-shaped member, said arcuate member, and said base portion, a ridge extending along the length of said panel from the inner side of said arcuate member near the level of said base portion, said ridge being generally parallel with base portion and extending in a direction away from said other edge of said panel, said arcuate slot being defined by:

structure extending outward from said base portion and having an arcuate outward facing surface, and a second arcuate member spaced outward from said structure and following said arcuate outward facing surface of said structure, said second arcuate member extending from said panel away from said one edge and having a free end defining said opening between said free end and said structure, said structure defining said arcuate slot having a slot formed therein along its length near said opening and extending generally parallel with said base portion, said second arcuate member having a ridge formed at its free end along its length and extending generally parallel with said base portion in a direction away from said one edge.

2. The panel of claim 1 wherein:

said first and second arcuate member and said arcuate slot are C-shaped in cross-section, said panel having spaced apart elongated support ridges located between said opposite edges, said elongated ridges being rounded in cross-section and extending along the length of said panel on the said outer side of said base portion, said inner side of said base portion is generally flat.

3. The panel of claim 2 comprising the combination therewith of means having slots formed therein which match the cross-section of said panel for receiving one of its edges along its width.

4. The panel of claim 1 wherein:

said base portion comprises two sections at right angles with respect to each other forming a corner panel.

5. The panel of claim 1 comprising:

a plurality of spaced apart elongated support ridges located between said opposite edges of said panel and extending outward from the outer side of said base portion, each of said elongated ridges being rounded in cross-section and extending along the length of said panel.

* * * * *